United States Patent [19]

Kryder

[11] Patent Number: 5,015,084

[45] Date of Patent: May 14, 1991

[54] SPORTS TRAINING APPARATUS INCLUDING A MIRROR ASSEMBLY WITH ADJUSTABLE LINE SEGMENTS

[76] Inventor: Ralph W. Kryder, 4481 S. Buffalo Rd. #27, Orchard Park, N.Y. 14240

[21] Appl. No.: 257,395

[22] Filed: Oct. 13, 1988

Related U.S. Application Data

[63] Continuation-in-part of Ser. No. 96,541, Sep. 14, 1987, abandoned, which is a continuation of Ser. No. 857,733, Apr. 29, 1986, Pat. No. 4,693,570, which is a continuation of Ser. No. 532,841, Sep. 16, 1983, abandoned.

[51] Int. Cl.[5] ..... G02B 5/08; G02B 7/18

[52] U.S. Cl. ..... 350/632; 350/631; 350/600; 434/257; 248/469

[58] Field of Search ..... 350/631, 642, 641, 600, 350/632, 616, 622; 434/257, 254, 252; 248/469, 473, 474

[56] References Cited

U.S. PATENT DOCUMENTS

| | | | |
|---|---|---|---|
| 365,183 | 6/1887 | Hufeland . | |
| 918,471 | 4/1909 | Reaves . | |
| 1,311,253 | 7/1919 | Stern | 350/600 |
| 1,605,221 | 11/1926 | Davis . | |
| 1,832,248 | 11/1931 | Schrader | 350/600 |
| 1,868,104 | 7/1932 | Hoegger . | |
| 1,879,592 | 9/1932 | Thomas | 350/600 |
| 2,214,639 | 9/1940 | Lenta . | |
| 2,215,396 | 9/1940 | Hoyt . | |
| 2,464,292 | 3/1949 | Chilo . | |
| 2,494,000 | 1/1950 | Robertson . | |
| 2,780,959 | 2/1957 | Mannon . | |
| 2,871,754 | 2/1959 | Marble | 350/600 |
| 2,875,528 | 3/1959 | 9arate . | |
| 3,140,550 | 7/1964 | Wayfield . | |
| 3,353,282 | 11/1967 | Sneed | 434/257 |
| 3,450,465 | 6/1969 | Prance et al. . | |
| 3,820,130 | 6/1974 | Cornelison et al. | 434/252 |
| 3,874,966 | 4/1975 | Garcia . | |
| 4,083,559 | 4/1978 | Owen, Jr. . | |
| 4,119,107 | 10/1978 | Pinzone et al. . | |
| 4,232,075 | 11/1980 | Gantz et al. . | |
| 4,299,446 | 11/1981 | Jenkins . | |
| 4,423,719 | 1/1984 | Hutchinson . | |
| 4,693,570 | 9/1987 | Kryder . | |

FOREIGN PATENT DOCUMENTS

| | | | |
|---|---|---|---|
| 3236019 | of 0000 | Fed. Rep. of Germany . | |
| 2024457 | 12/1971 | Fed. Rep. of Germany | 350/600 |
| 340581 | of 0000 | United Kingdom . | |

*Primary Examiner*—Jon W. Henry
*Attorney, Agent, or Firm*—Gunn, Lee & Miller

[57] ABSTRACT

An apparatus for training athletes comprising at least one mirror assembly which permits the athlete to view all his body movements is disclosed. The apparatus comprises adjustable frame supports for positioning the mirror assembly for use in various sports, such as, golfing, bowling and swimming.

18 Claims, 5 Drawing Sheets

SPORTS TRAINING APPARATUS INCLUDING A MIRROR ASSEMBLY WITH ADJUSTABLE LINE SEGMENTS

RELATED APPLICATIONS

This is a continuation-in-part of application Ser. No. 07/096,541 filed Sept. 14, 1987, now abandoned, which is a continuation of application Ser. No. 06/857,733 filed Apr. 29, 1986, now U.S. Pat. No. 4,693,570, which is a continuation of application Ser. No. 06/532,841 filed Sept. 16, 1983, now abandoned.

BACKGROUND OF THE INVENTION

This invention relates to apparatus for use in giving athletes instruction and more particularly, an apparatus including mirror assemblies which permit an athlete to study his body movements for improving his performance.

Many devices exist in the prior art directed to the problem of teaching athletes proper body movements for various sports. These devices include apparatus which require the strapping of the athletes limbs to various moving elements of the apparatus which provides an artificial character to the instruction and forces rather than guides the athlete through the proper motions.

One prior art device is described in U.S. Pat. No. 3,140,550 to Wayfield. The Wayfield patent describes an apparatus which enables a swimmer to be guided through the various stages of instructions and to learn the various movements of the body and how to coordinate them. The apparatus comprises a cabinet adapted to receive the body of a swimmer and dimensioned to provide unobstructed use of the arms and legs in executing swimming strokes. The cabinet includes a plurality of fluid expelling nozzles appropriately located for releasing fluid under pressure in a timed relation to indicate to the swimmer appropriate coordination of the parts of the bodY in executing swimming strokes.

A swimming instruction device is also disclosed by U.S. Pat. No. 2,875,528 to Garrett describing an apparatus on which a swimmer is supported at the correct level in the water under conditions in which both the swimmer and instructor may observe the arm and leg actions of the swimmer. The apparatus comprises a tank filled with water having a post appropriately located therein for supporting a swimmer at a desired level within the tank and leaving the arms and legs of the swimmer free to move. A series of windows and a system of mirrors are provided so that the instructor and swimmer, respectively, may observe the arm and leg movements in executing swimming strokes.

Owens, Jr., U.S. Pat. No. 4,083,559 describes an apparatus for training players in baseball and other sports. The apparatus employs a mirror which permits the player to view all body movements while projecting the ball toward the mirror as a target. The apparatus comprises a shock resistant mirror which may be variously mounted for angular adjustment to permit the player a full body view of his image. The mirror is suspended from a crossbar and may be positioned in an appropriate manner independently of a netting or like web surrounding the mirror.

Robertson, U.S. Pat. No. 2,494,000 describes a method and apparatus for teaching manual skills to golfers. Robertson provides a means for comparing the golfers body movements to follow as closely as possible the body movements of an expert performing the same stroke. This is accomplished by projecting the image of an expert performing a skill on a screen and superimposing on the continuously moving image of the expert the continuously moving image of the golfer performing the same skill as he endeavors to match his movements in time and position with those of the expert.

SUMMARY OF THE INVENTION

The apparatus of the present invention comprises a sYstem for aiding an athlete to develop proper body movements for various sports. The system includes at least one mirror assembly positioned to provide an athlete a view of his body movements. The mirror assembly is formed by two sheets of shatter resistant acrylic plastic material having reflective characteristics. The acrylic plastic sheets are held together by a peripheral channel-like framework engaging the peripheral edges of the sheet members. The framework includes means for supporting the mirror assembly on support structure for use in various sports for providing the athlete with a complete view of his body movements to aid the athlete in learning various skills. Grid lines and adjustable graphic lines extending across the mirror assembly provide a reference system for the athlete to repetitively and correctly align his body parts for learning various skills.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Figure 1:
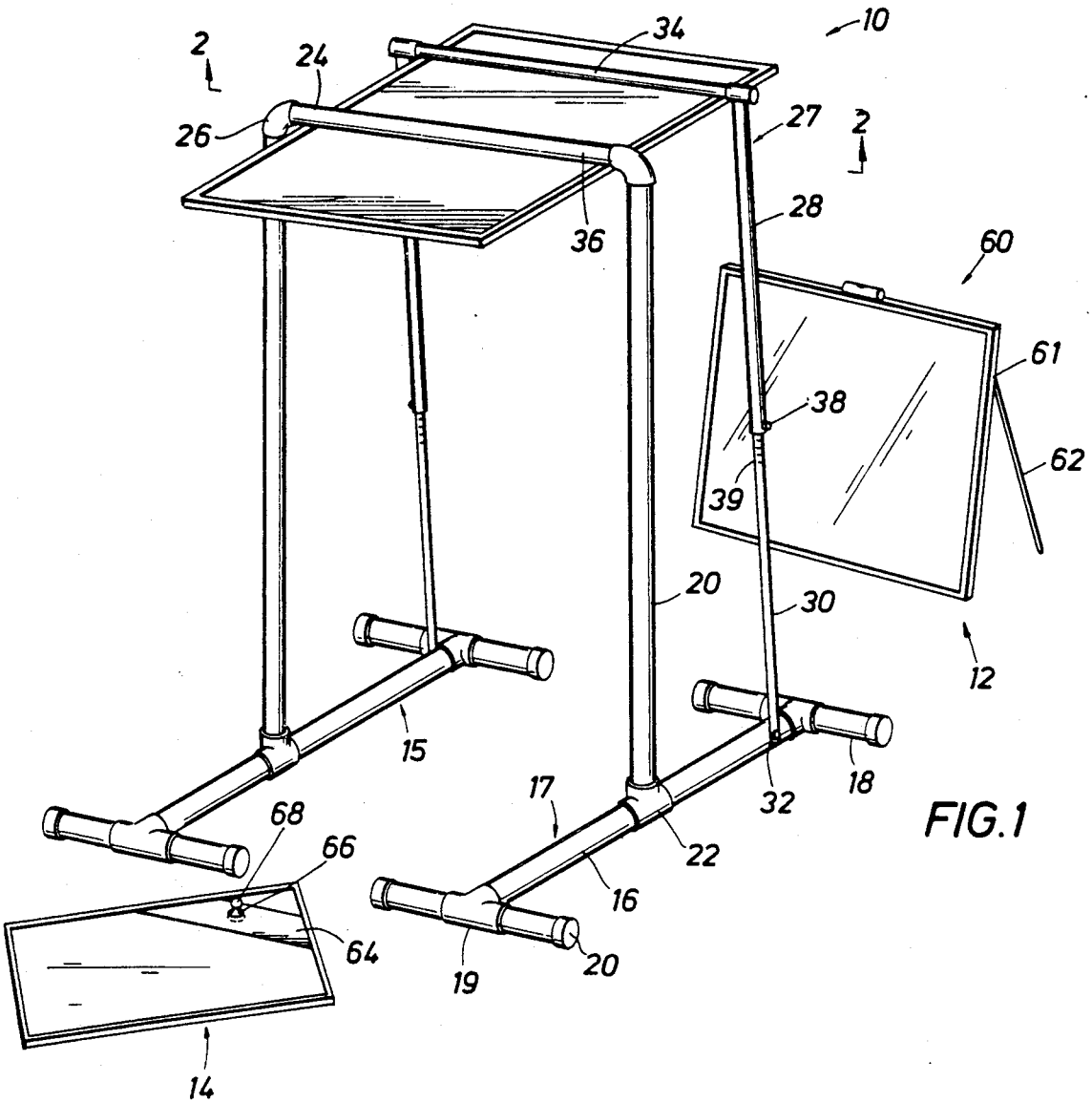
FIG. 1 is a perspective view of the system of the invention arranged for golf instruction.

Referring first to FIG. 1, the components of the sports training system of the invention are arranged for use by a golfer. The system comprises a mirror assembly supported on a frame generally identified by the reference numeral 10, a front mirror 12 and a stand on mirror 14. The frame 10 is formed utilizing a plurality of frame members and connectors. The structural components of the invention are fabricated of light weight material so-that the components may be easily assembled and disassembled as required. The components of the invention may be formed of any available light weight yet rigid material. In the preferred embodiment of the present disclosure the structural members and connectors of the invention are fabricated of PVC pipe.

In the embodiment of FIG. 1, the frame 10 comprises a stationary subframe 11 and an adjustable subframe 27. The subframe 11 includes base components 15 and 17 which are formed by base members 16 and 18 The base members 18 are connected across each end of the base members 16, thereby forming a base component substantially in the shape of an I. The ends of the base members 18 are closed by caps 20 so that debris, insects, bugs or the like do not enter the hollow tubular base members 16 and 18. T-connectors 19 connect the .base members 18 to the ends of base members 16.

Vertical support legs 20 ;extend above the base components 15 and 17 and are connected thereto by connectors 22. The leg members 20 extend a sufficient distance above the base components so that a golfer may freely swing a golf club without striking the frame 10 or the upper mirror assembly. The connectors 22 comprise a hollow tubular body sized to slip about the base member 16. The connectors 22 further include an upstanding hollow extension forming substantially a "T" shape. The hollow extension is sized to receive the lower end of the leg member 20 therein. A cross member 24 connected to the upper ends of the leg members 20 by angle connectors 26 completes the subframe 11 for supporting the upper mirror assembly 40.

The vertically adjustable subframe 27 permits the upper mirror assembly to be tilted as needed so that a golfer has a clear view of his swing. The adjustable subframe 27 is formed by a pair of adjustable leg members comprising a hollow outer cylindrical leg member 28 and an inner cylindrical leg member 30. The leg member 30 is connected to the base member 16 at 32 and the opposite end thereof is telescopically received within the member 28. The subframe 27 is completed by a cross member 34 which connects the leg members 28 and is attached to the upper mirror assembly 40.

Figure 2:
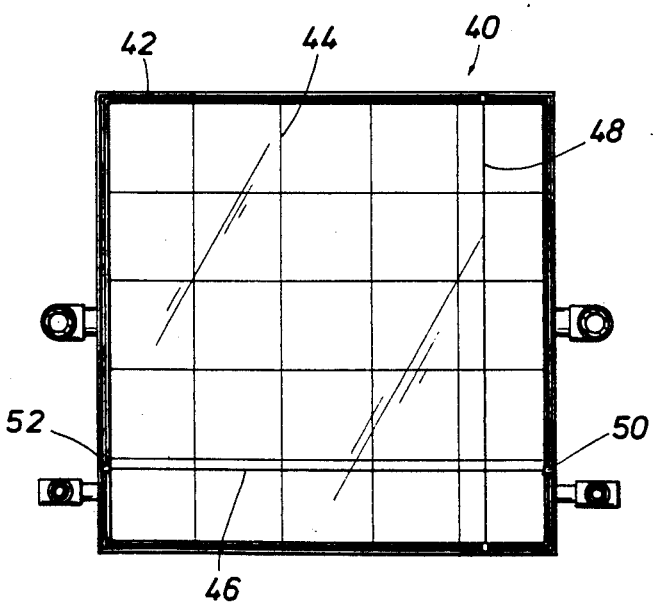
FIG. 2 is a plan view of the upper mirror assembly of the invention taken along line 2—2 of FIG. 1.

Referring now to FIG. 2, the upper mirror assembly, generally identified by the reference numeral 40, is shown in greater detail. The mirror assembly 40 comprises a sheet of clear acrylic material and a sheet of mirrored acrylic material in facing contact held within a frame 42 enclosing the edges thereof. The mirror assembly 40 and frame 42 are more fully disclosed in Applicant's U.S. Pat. No. 4,693,570 and the description thereof is incorporated by reference herein. It will be observed, however, that the mirror assembly 40 in the present disclosure includes a plurality of horizontal and vertical graphic or grid lines 44 etched on the surface of the mirrored acrylic sheet. Stretched across the surface of the mirror assembly 40 is a horizontal adjustable alignment line segment 46 and a vertical adjustable line segment 48. The line segments 46 and 48 are stretched between slide connectors 50 and 52 received within a slot defined by the frame 42. The alignment line segments 46 and 48 are adjustable across the surface of the mirror assembly 40 and are positioned to aid the golfer in developing a proper swing. For example, the alignment segment 46 may be positioned to indicate the proper position of the golf club on the back swing of a golf club. Alternatively, the alignment segment 46 may be located at a different position to indicate the proper position of the golf club upon completion of the forward swing of the golf club. The grid lines 44 and alignment line segments 46, 48 provide a reference system for the golfer or other athlete. The position of the athlete's body parts may be measured relative to the grid lines 44 and alignment line segments 46, 48 so that the athlete repetitively and correctly aligns his body parts for learning various skills. If a change in form is required, the change in position of the athlete's body parts is accurately measured relative to the grid lines 44 and alignment line segments 46, 48 and recorded so that the athlete will position his body parts in the same measured position each time he practices a particular skill. The alignment line segments 46 and 48 may also be printed on a removable acetate overlay. Each overlay would indicate the proper golf club alignment for different golf swings. The overlays adhere to the surface of the mirror assembly 40 and are easily removed so that they may be conveniently changed for practicing different golf swings.

The upper mirror assembly 40 is connected to the cross member 34 of the adjustable subframe 27 and a tubular member 36. The tubular member 36 is journalled about the cross member 24 as shown in FIG. 1. The tubular member 36 enables the mirror assembly 40 to be pivoted about the cross member 24. This is accomplished by raising or lowering the leg members 28 of the subframe 27 which telescope about the leg members 30. The leg members 28 and 30 are secured relative to each other by thumb screws 38 which are loosened when adjustment of the mirror assembly 40 is required. A scale 39 on the leg members 30 enables different users to properly adjust the mirror assembly 40 as required to meet their particular need.

In the arrangement of components depicted in FIG. 1, a separate mirror assembly 60 is positioned in front of the frame 10 so that a golfer may view his swing from the front. The mirror assembly 60 is positioned at an angle by a pair of adjustable legs 62 which may be collapsed and stored in the frame of the mirror assembly 60 when not in use. The legs 62 are pivotally secured to the frame of the mirror assembly 60 by retainer pins 61. The mirror assembly 60 is angled so that the golfer's image is reflect ed to the upper assembly 40 and then to the bottom mirror assembly 14. Thus, the golfer may view his swing from several angles without taking his eye off the golf ball.

The mirror assembly 14 is positioned on the ground below the upper mirror assembly 40. To avoid scratching or marring of the mirror surface of the mirror assembly 14, a plexiglas protective insert 64 is positioned over the mirror surface about the golf tee 66. The golf tee 66 includes a suction type base which adheres to the mirror surface of the mirror assembly 14. The plexiglas insert 64 includes tee opening permitting the golf tee 66 to extend threrethrough for supporting the golf ball 68 thereon. The golfer stands on the mirror assembly 14 and aligns his body relative to the golf ball 68. In doing so, he aligns his body relative to the alignment segments 46 and 48 which are reflected from the upper mirror assembly 40. Furthermore, the golfer also sees a frontal view of his stance, which frontal view is reflected from the mirror assembly 60. Thus, the golfer has a complete view of his swing as he hits the golf ball 68.

Figure 3:
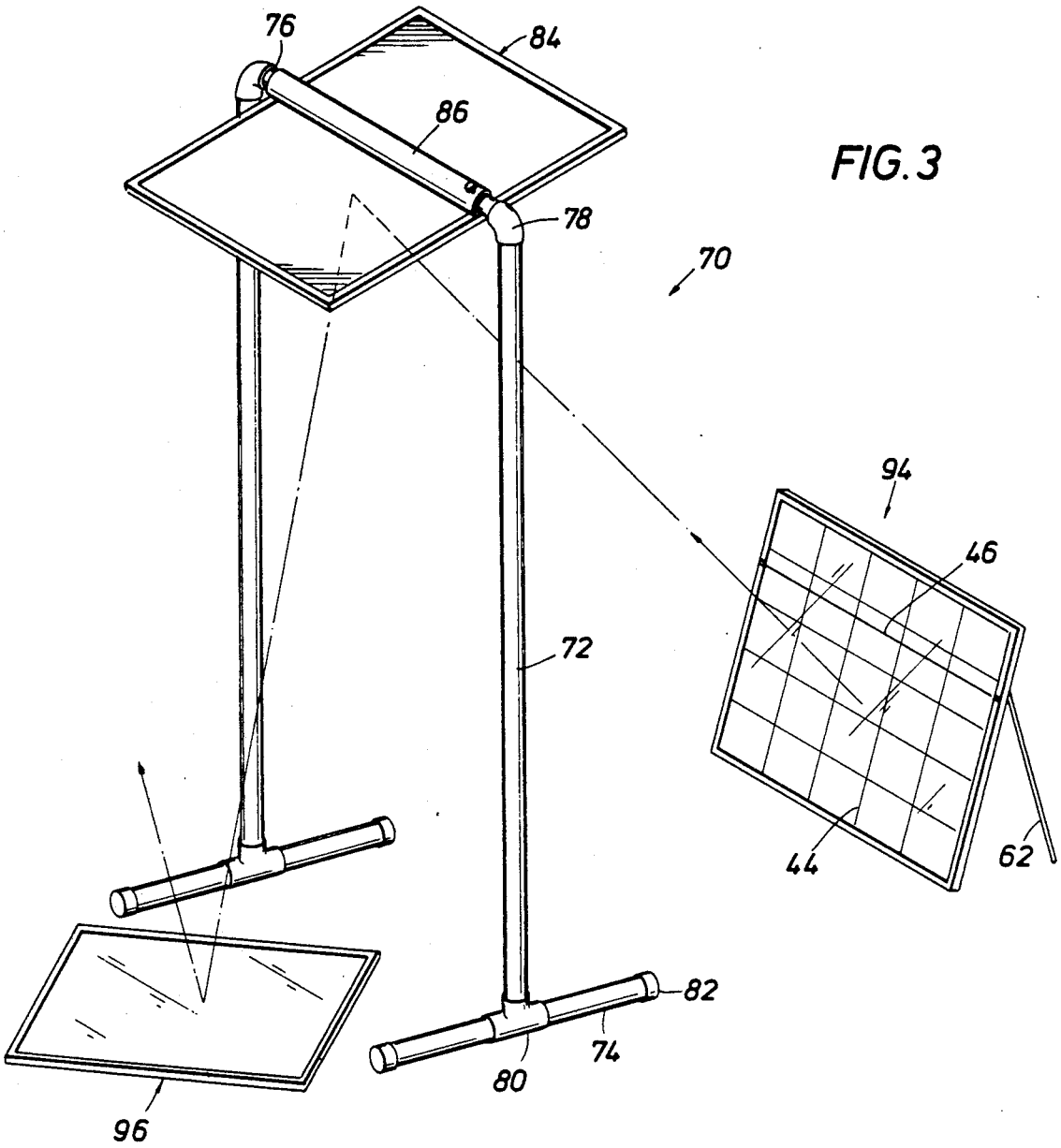
FIG. 3 is an alternate embodiment of the system of the invention for use by a golfer.

Referring now to FIG. 3, an alternate embodiment of the golf training apparatus of the invention is disclosed. The apparatus, generally identified by the reference numeral 70, comprises a pair of upstanding leg members 72 which are spaced from each other and supported by ground engaging support members 74. The upstanding leg members 72 are connected at an upper end thereof by a cross member 76. The cross member 76 is connected to the leg members 72 by corner connectors 78. The leg members 72 are connected to the bottom support members 74 by T-shaped connectors 80. The ends of the bottom support members 74 are closed by caps 82.

The upper mirror assembly 84 is journalled about the cross member 76 as shown. The upper mirror assembly 84 is mounted to a hollow tubular member- 86 which extends across the back of the mirror assembly 84 and is attached at approximately the mid point thereof. The tubular member 86 is journalled about the cross member 76 so that the mirror assembly 84 may be tilted as required by the golfer. A scale on the cross member 76 indicates the angular position of the upper mirror assembly 84.

Figure 4:
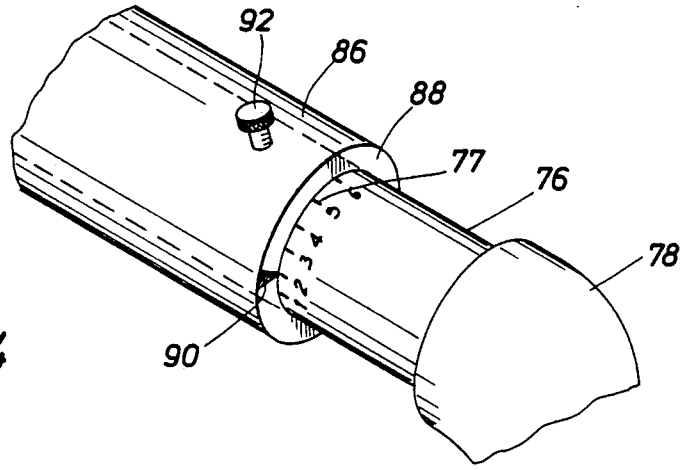
FIG. 4 is an enlarged view of the mechanism for locking a mirror assembly in a desired angle.

It will be observed that the scale on the cross member 76, as best shown in FIG. 4, includes a plurality of numbered registration points 77. The end 88 of the tubular member 86 includes a pointer or notch 90 which may be aligned with the registration points 77 on the cross member 76. The tubular member 86 is retained in a selected position by a thumb screw 92 which may be loosened to permit relative rotation between the cross member 76 and the tubular member 86 and then tightened to secure the tubular member 86 and thereby the upper mirror assembly 84 in a selected position.

In the embodiment of FIG. 3, a remote mirror assembly 94 is positioned in front of the golfer. The mirror assembly 94 includes horizontal and vertical line segments 44 as well as an adjustable horizontal alignment segment 46 to aid the user is developing a proper swing. The golfer uses the apparatus 70 by standing on the bottom mirror assembly 96 so that he can see his image reflected in the mirror assemblies 84 and 94 in the manner previously described herein with regard to the embodiment of FIG. 1.

Figure 5:
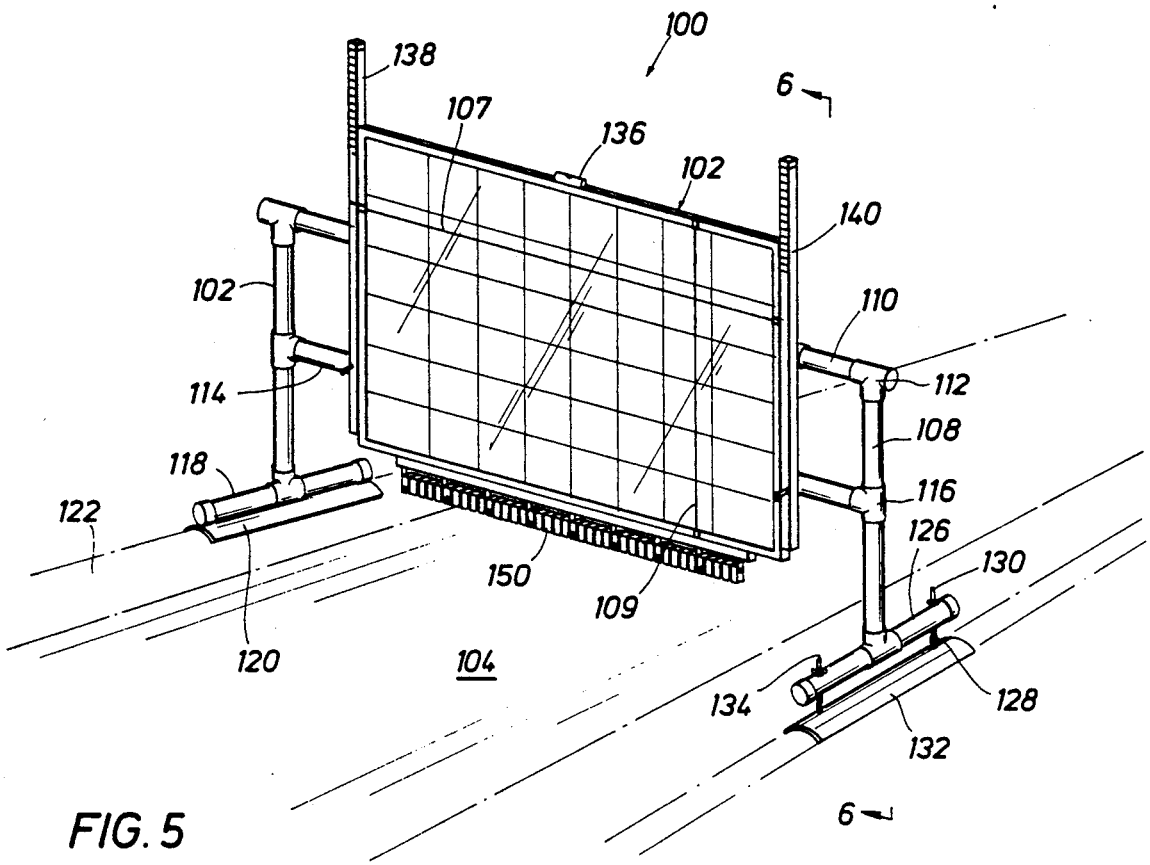
FIG. 5 is a perspective view of the system of the invention for bowling instruction.
Figure 6:
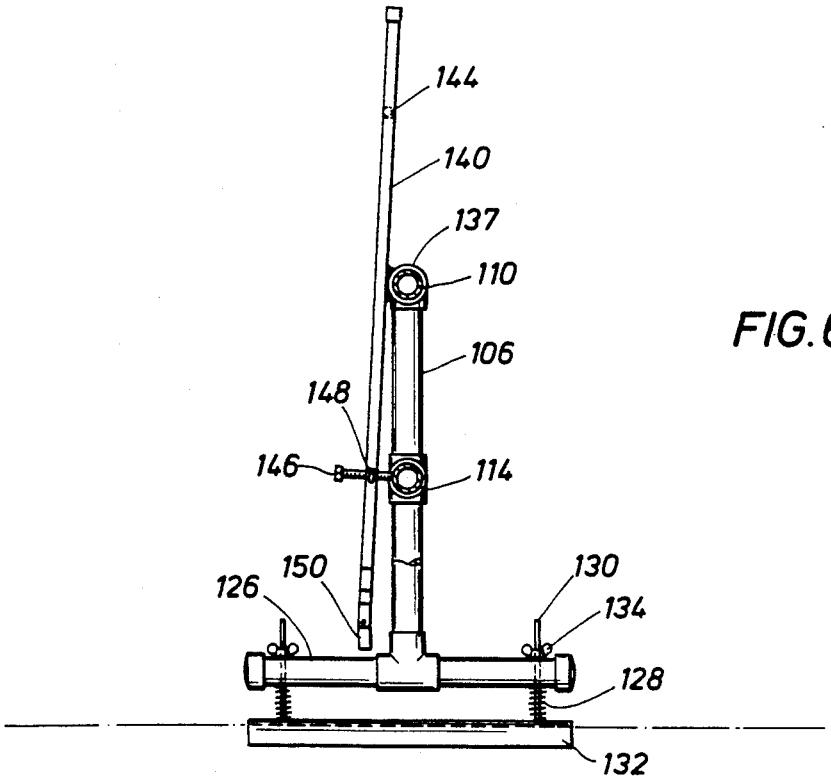
FIG. 6 is a side view of the components of the invention arranged for use by a bowler taken along lines 6—6 of FIG. 5.

Referring now to FIG. 5, the bowling embodiment of the invention is generally identified by the reference numeral 100. The apparatus 100 comprises a mirror assembly 102 mounted across a bowling lane 104. The mirror assembly 102 is mounted on a supporting framework comprised of a stationary leg member 106 and an adjustable leg member lOS. The leg members 106 and 108 are connected by a horizontal mirror support 110 which is connected to the upper ends of the legs 106 and 108 by end connectors 112. Additional stability is provided by a bottom horizontal arm 114 which extends across the back of the mirror assembly 102. The horizontal arm 114 is mounted to the leg members 106 and 108 by T-connectors 116. The leg member 106 is supported by a base member 118 which is mounted to a cap cover 120. The cap cover 120 has a substantially semicircular profile matching the curvature of the bowling lane ball return cap 122.

The adjustable leg 108 is supported on a base member 126 which rests on a pair of springs 128 journalled about connector bolts 130. The bolts 130 connect the cap cover 132 to the base support member 126. The springs 128 separate the base member 126 from the cap cover 132 and have sufficient spring force to lift the end of the apparatus 100 so that the mirror assembly 102 may be positioned substantially parallel to the bowling lane 104. Wing nuts 134 threaded on the bolts 130 permit sufficient vertical adjustment of the leg member lOS so that the mirror assembly 102 may be properly leveled. A bubble level 136 provides visual indication that the mirror assembly 102 is properly positioned across the bowling lane 104.

Figure 7:
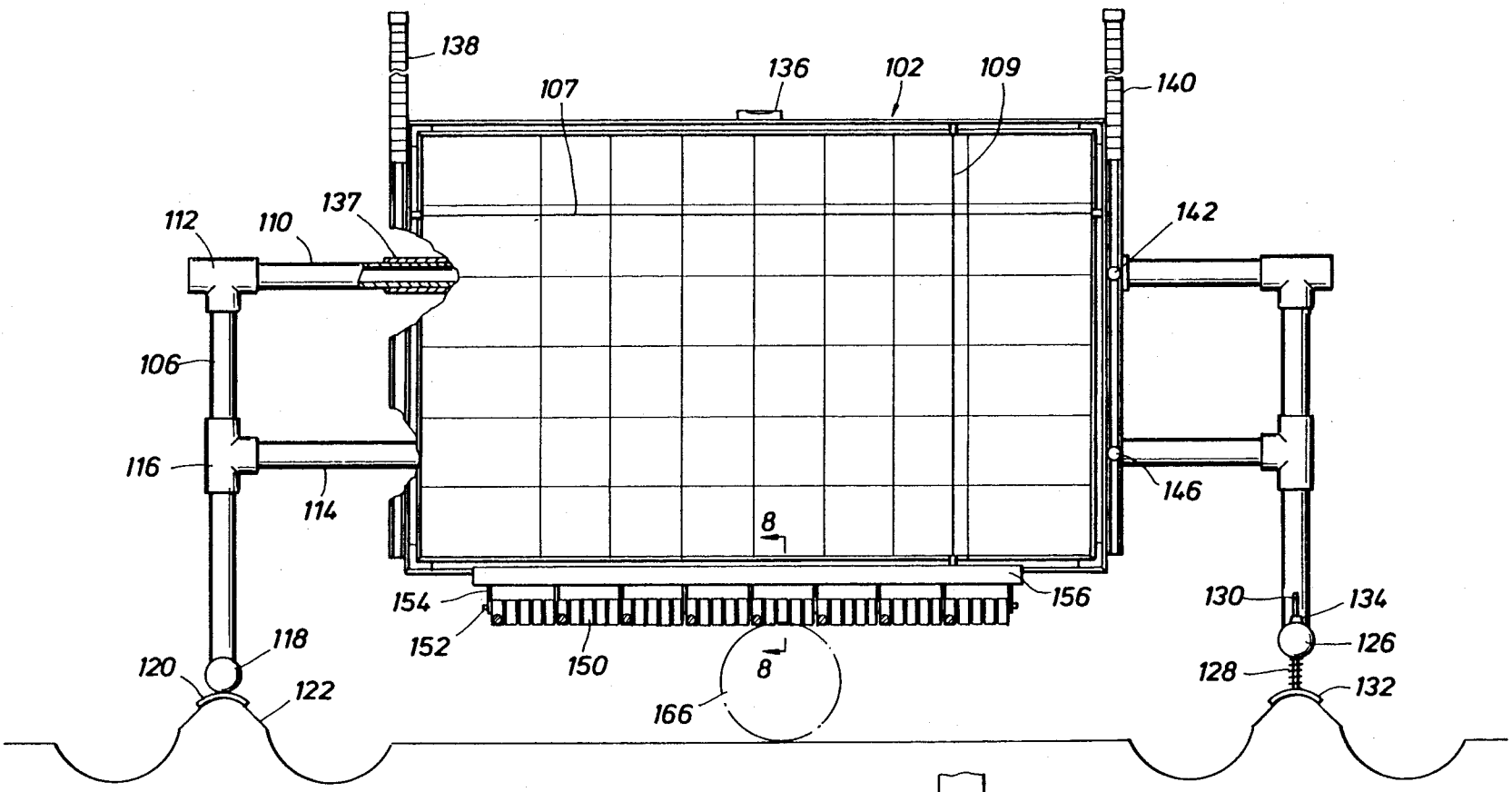
FIG. 7 is a partially cut away front view of the bowling embodiment of the invention.

The mirror assembly 102 is pivotally supported on the horizontal support arm 110 by a hollow tubular member 137 which is connected to mirror supports 138 and 140. The mirror supports 138, 140 present an interconnecting flange profile for mating engagement with a corresponding profile of the mirror frame assembly 102 as best shown in FIG. 7. The support arms 138, 140 are connected to the tubular member 137 by bolts 142 or any suitable connecting means. Retainer pins 144 extend through apertures formed in the support members 138 and 140 and are received in corresponding apertures formed in the frame of the mirror assembly 102, for mounting the mirror assembly 102 on the support member 138 and 140. The mirror assembly 102 may be adjusted vertically along the mirror supports 138, 140. A plurality of spaced apertures are formed along the top portion of the vertical edges of the mirror assembly frame so that the mirror assembly 102 may be adjusted between a minimum and maximum height above the bowling lane 104. Tilt adjustment of the mirror assembly 102 is provided by a pair of threaded bolts 146 which extend through the supports 138 and 140. The bolts 146 are threaded through nuts 148, captured in the support members 138 and !40 and engage the horizontal support 114 which extends behind the mirror assembly 102. The bolts 146 are adjusted so that the mirror assembly 102 tilts slightly back from vertical so that a bowler may have a complete view of his body movements as he approaches and throws the bowling bowl down the bowling lane 104.

Figure 8:
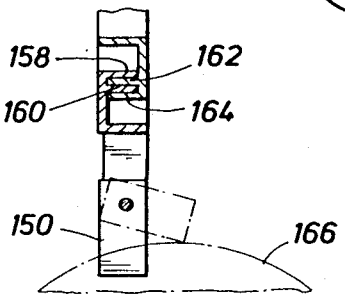
FIG. 8 is a sectional view taken along line 8—8 of FIG. 7.

To aid the bowler in visually observing the travel of the bowling ball down the bowling lane 104, a plurality of spinners 150 are mounted across the lower horizontal edge of the mirror assembly 102. The spinners 150 are pivotally mounted on a rod 152 which is supported on a plurality of supports 154 extending downwardly from a flange connector 156. The connector 156 includes a pair of flange members 158 and 160 which slide over flange members 162 and 164 formed by the surrounding frame of the mirror assembly 102, as best shown in FIG. 8. The spinners 150 hang over each board of the bowling lane 104 and indicate by spinning motion exactlY which board of the bowling lane 104 is traversed by the bowling ball 166. In setting up the bowling embodiment of the invention, the mirror assembly 102 is vertically adjusted so that the bowling ball 166 slightly touches the spinners 150 as it passes under the mirror assembly 102.

The bowling embodiment of the invention is adjusted to the specific lane conditions of an individual bowler. The adjustable leg 108 is placed over the shutter of the two lane caps 122. The apparatus 100 is adapted for left or right use by slipping the mirror assemblY 102 off the mirror support 110 and rotating the frame of the apparatus 100 so that the adjustable leg 108 is over the shorter of the lane caps 122. The mirror assembly 102 is then slipped back onto the mirror support 110 which is then secured to the leg supports 106 and 108. The adjustable line segments 107 and 109 provide a means for the bowler to practice a perfect pendulum swing in the vertical plane and to consistently push away at the same point thereby controlling the speed of the bowling ball. The spinners 150 at the bottom of the mirror assembly 102 provide instant verification of which board the bowling lane 104 is hit by the bowler. The mirror assembly 102 does not block the view of the pins from the starting point of the bowler or for the follow through.

Figure 9:
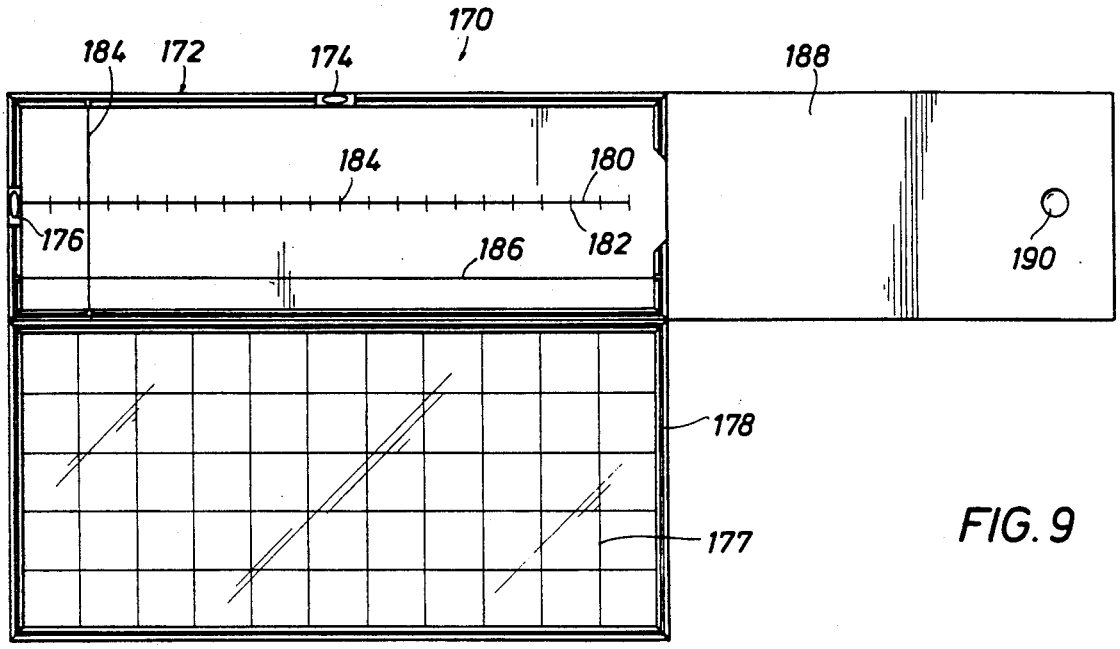
FIG. 9 is a top plan view of the golf putting embodiment of the invention.

Referring now to FIG. 9, the putting embodiment of the invention is generally identified by the reference numeral 170. The apparatus 170 comprises a mirror assembly 172 which includes a pair of bubble levels 174 and 176 so that the mirror assembly 172 may be properly leveled for use by a golfer to practice his putting form. The mirror assembly 172 may be connected to an add on foot grid assembly 178. The assemblies 172 and 178 are interconnected in the fashion described in applicant's U.S. Pat. No. 4,693,570 which is incorporated by reference herein. The foot grid 178 includes a plurality of horizontal and vertical grid lines 177 to aid the golfer in determining proper positioning of his feet.

The mirror assembly 172 includes a horizontal grid centerline 180. Extending perpendicularly across the centerline 180 is a plurality of registration marks 182. The centerline 180 and registration marks 182 are etched onto the surface of the mirror assembly 172. It is understood however that the centerline 180 and registration marks 182 may be painted on or otherwise applied to the mirror assembly 172. A small indention 184 is provided for positioning and retaining the golf ball on the centerline 180. Movable alignment segments 184 and 186 extend vertically and horizontally across the mirror assembly 172. In FIG. 9, the alignment segment 184 is positioned to aid the golfer in developing a proper back swing. The alignment segment 186 aids the golfer to align his shoulders square with the golf ball. The registration lines 182 aid the golfer in learning to equalize his swing and keep the putter square to the golf ball. A removable putting green 188 including a cup 190 may be connected to the mirror assembly 172, if desired. The edge frame of the mirror assembly 172 adjacent the putting green 188 is notched permitting the golfer to put the golf ball to the cup 190.

Figure 10:
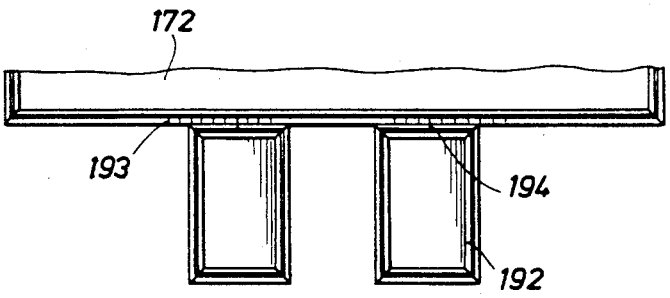
FIG. 10 is a partial top plan view of foot pads of the invention for use with the putting embodiment.

Often times golfers concentrate so intently on their swing and approach to the ball that proper positioning of the feet is forgotten. In FIG. 10, adjustable foot pads 192 may be substituted for the foot grid 178 shown in FIG. 9. The adjustable foot pads 192 interconnect with the edge frame of the mirror assembly 172 in the manner described in applicant's U.S. Pat. No. 4,693,570. The edge of the mirror assembly 172 is provided with a scale 193 so that the foot pads 192 may be positioned along the scale and adjusted to the stance of an individual golfer. Registration lines 194 on the foot pads 192 insure that the foot pads 192 will always be positioned identically with each use of the putting embodiment of the invention. Thus, a golfer may concentrate on his swing and approach to the golf ball without worrying regarding the proper positioning of his feet relative to the golf ball. After repeated use, the golfer develops a proper stance which he will use on the golf course when the foot pads 192 are no longer available.

Figure 11:
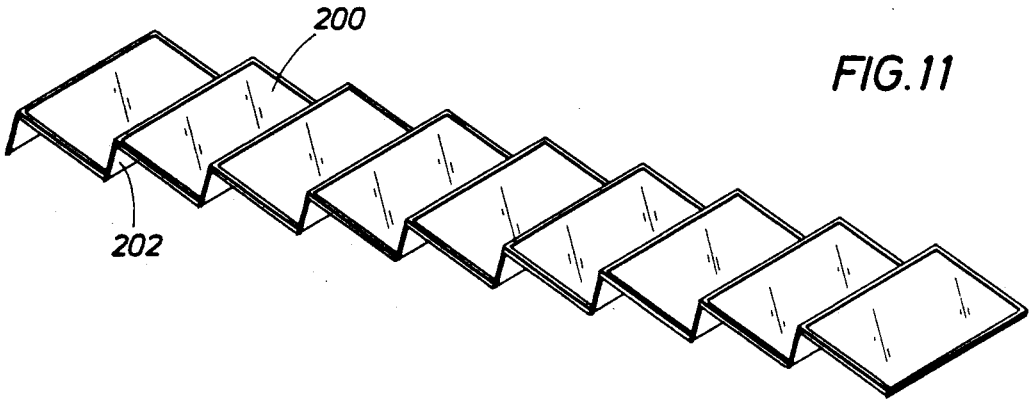
FIG. 11 is a perspective view of a mirror assembly of the invention for swimming instruction.

Referring now to FIG. 11, a series of mirror assemblies 200 are shown connected end to end. The mirror assemblies 200 are angularly positioned to each other, yet are in line and connected end to end by a plurality of plexiglas or plastic sheets which raise the forward end of each of the mirror assemblies 200, thus forming an interlocking stair step mirror of substantial length. Connection of the mirror assemblies in this fashion is particularly useful in swimming instruction. The mirror assemblies 200 are interconnected along the bottom of the pool so that a swimmer may see his image before he reaches a particular mirror. When the mirror assemblies of the invention are placed flat along the bottom of the pool, the swimmer must bend his head down into the water to clearly view his body and swimming strokes. Utilization of the stair step design as shown in FIG. 11 permits the swimmer to look ahead and keep his head up in the normal swimming position.

In summary, the present invention discloses a sports training apparatus which may be conveniently used in various sports for athletic instruction by permitting athletes to study their body movements and thereby improve their performance.

While the foregoing is directed to the preferred embodiment of the present invention, other and further embodiments of the invention may be devised without departing from the basic scope thereof, and the scope thereof is determined by the claims which follow.

What is claimed is:

1. A sports training apparatus comprising:

(a) a mirror assembly;

(b) a frame extending about said mirror assembly, said frame including channel means extending about said frame and integral therewith;

(c) wherein said mirror assembly includes adjustable line segment means extending across the surface of said mirror assembly, said adjustable line segment means being stretched between slide connectors slidably mounted on said frame of said mirror assembly; and (d) wherein said mirror assembly includes grid means formed thereon for aiding the athlete to develop proper skills for use in various sports.

2. The apparatus of claim 1 including a stationary subframe for supporting said mirror assembly above an athlete for use in various sports.

3. The apparatus of claim 2 further including an adjustable subframe supporting said mirror assembly in cooperation with said stationary subframe for angularly aligning said mirror assembly above a golfer for us in golf instruction.

4. The apparatus of claim 3 including a remote mirror assembly for positioning in front of a golfer permitting the golfer a front view of his stance and golf swing.

5. The apparatus of claim 4 including a stand-on mirror assembly for positioning on the ground surface, wherein a golfer stands on said stand-on mirror assembly for viewing his body movements reflected from said mirror assembly and said remote mirror assembly while looking at a golf ball resting on a tee secured to said stand-on mirror assembly.

6. The apparatus of claim 5 wherein said stand-on mirror assembly includes a mar resistant insert positioned on the surface thereof, said insert including an aperture extending therethrough for receiving an upstanding stem of a golf tee through said aperture, the golf tee including a base which is captured between said insert and the surface of said stand-on mirror assembly.

7. The apparatus of claim 1 wherein said mirror assembly is pivotally mounted on a stationary subframe, aid stationary subframe including a pair of spaced upstanding leg members supported on ground engaging support means and connected at the upper ends thereof by a cross member, said mirror assembly being pivotally supported by said cross member.

8. The apparatus of claim 7 wherein said mirror assembly is mounted on a tubular member journalled about said cross member, said cross member including a scale thereon for indicating the angular position of said mirror assembly.

9. The apparatus of claim 1 including a support frame comprising a pair of spaced leg supports connected by horizontally extending cross members and adapted for positioning said mirror assembly across a bowling lane, said leg members including base supports having a curved profile for engagement with the lane caps of the bowling lane.

10. The apparatus of claim 9 wherein one of said leg supports includes adjustment spring means enabling vertical adjustment of said one leg support for aligning said mirror assembly relative to the bowling lane.

11. The apparatus of claim 10 including mirror assembly frame supports, said frame supports being spaced from each other and connected to a tubular member journalled about one of said horizontal cross members, said frame supports including interlocking flange means cooperating with corresponding flange means on said frame extending about said mirror assembly for joining said mirror assembly to said frame supports.

12. The apparatus of claim 11 including tilt adjustment means for tilting said mirror assembly relative to vertical.

13. The apparatus of claim 12 including a plurality of spinners mounted across a lower edge of said mirror assembly, said spinners corresponding to specific boards of the bowling lane and providing visual indication by spinning motion of the board traversed by the bowling ball as it passes under said mirror assembly.

14. The apparatus of claim 13 including scale means on said frame supports for vertical alignment of said mirror assembly, said mirror assembly being supported on said frame supports by removable retainer pins extending through apertures in said frame supports and received in corresponding apertures formed in the frame of said mirror assembly.

15. The apparatus of claim 1 wherein said mirror assembly comprises a horizontally positioned putting mirror assembly for use in putting instruction, said edge extending frame being notched at one end permitting a golf ball to be putted to a detachable putting green.

16. The apparatus of claim 15 including an add-on foot grid detachably connected to said putting mirror assembly, said foot grid including horizontal and vertical grid lines for aiding a golfer in properly positioning his feet when in a putting stance.

17. The apparatus of claim 16 wherein said putting mirror assembly includes a centerline and a plurality of spaced registration marks perpendicular to aid centerline, said putting mirror assembly further including an indentation for supporting a golf ball on the surface of said putting mirror assembly.

18. The apparatus of claim 17 including a pair of adjustable foot pads slidably connected to said putting mirror assembly, said foot pads including registration marks for alignment with a scale formed on the frame of said putting mirror assembly enabling a golfer to position said foot pads in the identical spot relative to the golf ball with each use of said foot pads.

* * * * *